US008291628B2

(12) United States Patent
Acworth

(10) Patent No.: US 8,291,628 B2
(45) Date of Patent: Oct. 23, 2012

(54) ART DISPLAY SYSTEM AND METHOD

(76) Inventor: Brian Acworth, Centerport, NY (US)

( * ) Notice: Subject to any disclaimer, the term of this patent is extended or adjusted under 35 U.S.C. 154(b) by 183 days.

(21) Appl. No.: 12/653,126

(22) Filed: Dec. 8, 2009

(65) Prior Publication Data

US 2011/0137665 A1 Jun. 9, 2011

(51) Int. Cl.
*G09F 13/00* (2006.01)

(52) U.S. Cl. ..... 40/554; 40/463; 362/351; 362/362; 29/428; 29/592.1; D26/93

(58) Field of Classification Search ..... 705/26.1–27.2; D26/93–112; 40/463, 554; 29/428, 592.1; 362/351, 362
See application file for complete search history.

(56) References Cited

U.S. PATENT DOCUMENTS

| | | | | |
|---|---|---|---|---|
| 137,306 | A | 4/1873 | House | |
| 1,463,722 | A | 7/1923 | O'Boyle | |
| 1,728,166 | A | 9/1929 | Horton | |
| 1,817,091 | A | 8/1931 | Miller | |
| 1,930,048 | A | 10/1933 | Harding | |
| 2,177,204 | A | 10/1939 | Buzick | |
| 2,483,354 | A * | 9/1949 | Stiffel | 362/358 |
| 2,483,357 | A | 9/1949 | Stiffel | |
| 2,637,805 | A | 5/1953 | Jaidas | |
| 2,677,756 | A | 5/1954 | Priester | |
| 2,680,317 | A | 6/1954 | Lewis | |
| 2,781,444 | A | 2/1957 | Noguchi | |
| 2,823,477 | A | 2/1958 | Willard | |
| 2,974,435 | A | 3/1961 | Eschenroeder | |
| 3,023,307 | A | 2/1962 | Okamoto | |
| 3,105,315 | A | 10/1963 | Snethen | |
| 3,304,640 | A | 2/1967 | Swartz | |
| 3,382,358 | A | 5/1968 | Pike | |
| 3,742,210 | A | 6/1973 | Chapman | |
| 3,764,801 | A | 10/1973 | Mainieks | |
| 3,787,676 | A | 1/1974 | Korach | |
| 4,075,684 | A | 2/1978 | Witz | |

(Continued)

FOREIGN PATENT DOCUMENTS

DE 102006033944 A1 1/2008

(Continued)

OTHER PUBLICATIONS

United Kingdom Intellectual Property Office, International Search Report under Section 17, Application No. GB1002334.9, May 19, 2010. 1 page.

(Continued)

*Primary Examiner* — Michael Misiaszek
(74) *Attorney, Agent, or Firm* — Alfred M. Walker

(57) ABSTRACT

A system for displaying illuminated art which includes an electrical/framework kit and a flexible media imprinted with artwork which combine for display of the artwork as on a table lamp or hanging lamp. The media is constructed out of a flexible sheet of plastic or a fabric-plastic laminate which is preferably bowed into a cylindrical or oval shape. The framework for supporting the illuminated media includes a slot provided in a central ring to accommodate the electrical cord of an electrical assembly, whereby the lamp is pre-wired so that user assembles it without having to wire the electrical components and wires. A digital library is set up where museums or other institutions or businesses can upload images of selected artworks to be printed on the flexible sheets of the media.

15 Claims, 14 Drawing Sheets

U.S. PATENT DOCUMENTS

| | | | | |
|---|---|---|---|---|
| 4,163,998 | A | 8/1979 | Anderson | |
| 4,164,822 | A | 8/1979 | Batton | |
| 4,268,896 | A | 5/1981 | Mann | |
| 4,337,505 | A | 6/1982 | Heimo | |
| 4,344,115 | A | 8/1982 | Pickens | |
| 4,354,222 | A | 10/1982 | Gall | |
| 4,383,291 | A | 5/1983 | Gall | |
| 4,817,315 | A | 4/1989 | Kammerer | |
| 6,000,817 | A | 12/1999 | Chan | |
| 6,183,115 | B1 | 2/2001 | Durando | |
| 6,647,651 | B2 | 11/2003 | Cutright | |
| 6,736,530 | B2 * | 5/2004 | Thevenot | 362/362 |
| 6,821,002 | B1 | 11/2004 | Morgen | |
| D544,369 | S | 6/2007 | Liu | |
| 7,347,593 | B1 * | 3/2008 | Swanson | 362/357 |
| 2002/0112386 | A1 * | 8/2002 | Thomas | 40/554 |
| 2005/0016667 | A1 | 1/2005 | Dwight et al. | |
| 2006/0050517 | A1 * | 3/2006 | LaFleiche et al. | 362/351 |
| 2006/0239012 | A1 | 10/2006 | Bin | |
| 2008/0130297 | A1 | 6/2008 | Hui | |

FOREIGN PATENT DOCUMENTS

| | | | |
|---|---|---|---|
| FR | 2295683 | A7 | 7/1976 |
| GB | 1019865.3 | A1 | 3/2011 |
| JP | 2004296168 | A | 10/2004 |
| JP | 2007280629 | A | 10/2007 |
| JP | 2007280629 | A1 | 10/2007 |
| JP | 2000268611 | A | 9/2009 |
| WO | WO92/04578 | A1 | 3/1992 |

OTHER PUBLICATIONS

Orange County Industrial Plastics (OCIP), Plastic Industry Innovations & Solutions, Styrene Sheet, website, (c)2000, 1 page.

Lamps Plus, photograph of lamp, 1 page, 2009.

Michelangelo lamp, photograph of lamp,1 page,2009.

Happy Trail, Roy Rogers & Trigger ,lampshade photograph,1 page, 2009.

Kokopelli Hand Painted Lampshade,www.aanativearts.com, 2 pages, 2009.

The Lampshade Shop, internet catalog excerpt, 1 page, 2009.

HP Researchers Show Prototype of Printed Plastic,Color Display, www.hpl.hp.com, 2 pages, 2004.

How Can You Digitize All Your Old Maps, Architectural Drawings, Sketches or Other Large Artwork,www.cameras-scanners-flaar.org, 3 pages, 2009.

HP Graphic Arts, HP Designjet L2500 Printer series—Key benefits, www.hp.com, 1 page, 2009.

* cited by examiner

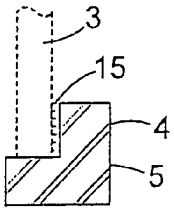
FIG. 4
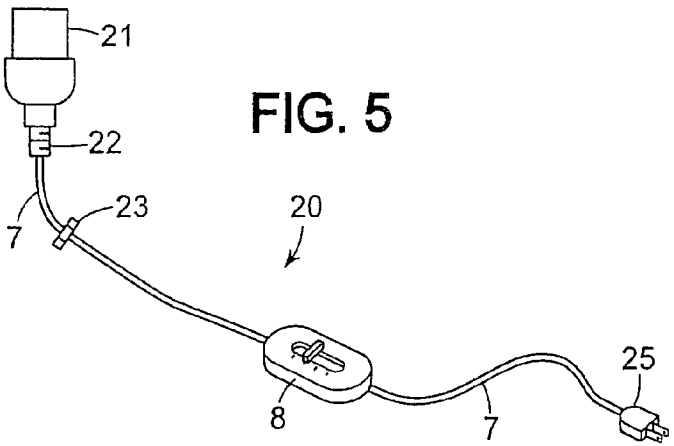
FIG. 5
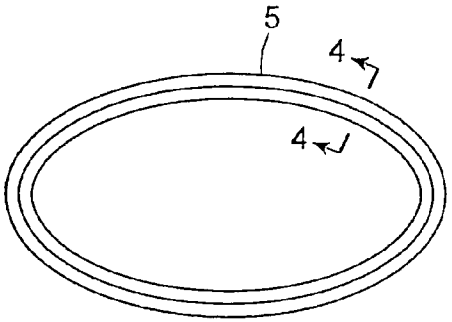
FIG. 3
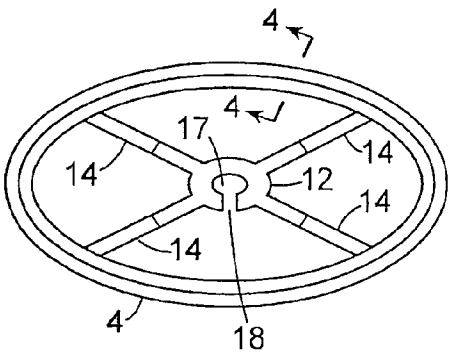

FIG. 8 IDU ASSEMBLY

*IF TABLE TOP UNIT IS A PEDESTAL MODEL SUBSTITUTE THE FOLLOWING: SLIDE ELECTRIC WIRE THROUGH SLOT IN SUPPORT, FRAME, INSERT LAMP SOCKET, THREAD SUPPORT TUBE ONTO NIPPLE ON LAMP SOCKET, SCREW SECOND NIPPLE INTO OTHER END OF TUBE, INSERT INTO SECOND SUPPORT FRAME AND TIGHTEN NUT TO SECURLY ATTACH PEDESTAL.

FIG. 9 ORDER SET-UP

FIG. 10 CUSTOMER ORDER FULFILLMENT AT GIFT SHOP

ART DISPLAY SYSTEM AND METHOD

FIELD OF THE INVENTION

The present invention relates to a method displaying art in an illuminated display.

BACKGROUND OF THE INVENTION

Museum gift shops often have items for purchase related to their purpose. With the advent of wide format high resolution digital printers and the availability of art images on digital media, low volume translucent reproductions of art or designs for illuminated display are feasible.

Visitors to museums are varied. Some arrive by car and would therefore be able to purchase a bulky item; place it in a car, and take it home. Others arrive by public transportation such as a subway or bus, and therefore their carrying capability is limited. Still others may arrive by rental car while on a distant trip; but they must return by air thereby limiting the bulk and fragility of their purchase at a museum shop. For some, purchasing a compactly packaged kit consisting of a customer selected electric/frame kit and a customer selected art image packaged separately but sold in combination for home assembly is ideal; others would balk at purchasing anything that would require even the minimum of assembly involvement. Customer order fulfillment by purchase, purchase of an assembled unit at point of purchase or by shipment of an assembled unit to their home, assembled by the museum or by the company per museum order, should all be accommodated by the museum shop. Also, storage space for stock is at a premium at a typical museum shop and this is a factor favoring inventory of compactly packaged kits that can be flexibly combined.

The prior art reveals many types of illuminated display units. Some are for the display of two dimensional art reproductions. A sampling of such patents follows. For example, the lamp shade of Lewis, U.S. Pat. No. 2,660,317, has a fenestration on its surface and a recessed plate for accepting an art object in sheet form to be illuminated indirectly by reflected light from the lamp. Buzick's picture display panel for lamp shades (U.S. Pat. No. 2,177,204) is primarily for display of black and white pictures printed on translucent paper by transmitted light. Morgen's lightbox lampshade (U.S. Pat. No. 6,821,002) provides uniform illumination on its surface for viewing photographic slides placed on its surface. The Swanson U.S. Pat. No. 7,347,593 relates to a Giclee printed lamp shade that is capable of displaying a high resolution art reproduction made from a digital image file using a process for adhering an image printed on canvas to the surface of an existing lamp shade.

Many other patents in the prior art deal with the bulkiness of lampshades. They relate to knockdown, collapsible, or foldable lamp shades which can be shipped or stored compactly and then assembled and used on a lamp. Four such U.S. patents and one US patent application are identified here as a sampling of the field. They are U.S. Pat. Nos. 3,742,210 of Champan, 3,787,676 of Korach, 4,075,684 of Witz, 4,354,222 of Gall, and U.S. patent application US 2006/0239012 of Bin. None of these relate directly to the display of art.

Indeed, while the prior art teaches several approaches to the design of illuminated display units for displaying art or storing lampshade frames more compactly, none describe an efficient method to display art or any selected image in the home or elsewhere on an illuminated display unit that is compatible with the operation of a museum gift shop or other institution or business establishment.

OBJECTS OF THE INVENTION

The main object of this invention is to create an efficient business model that serves the need of museum gift shops and their customers so that art may be enjoyed in the home after it is appreciated in the museum. Other venues besides museum gift shops can be similarly served. Along the way, a viable manufacturing business is also created.

Other objects which become apparent from the following description of the present invention.

SUMMARY OF THE INVENTION

Museums and particularly museum gift shops have been identified as potential participants in the utilization of this invention and display by a purchaser in a home is anticipated throughout this narrative but this should be interpreted only as an example and should not be regarded as limiting the scope of the usefulness of the invention. Almost any institution or business could be a potential participant and the display unit could be located anywhere for any purpose.

The vehicle for such a method is an illuminated display unit (IDU) for displaying two dimensional high quality reproductions of art work. The concept for the IDU of this invention differs from that of an ordinary lamp and lampshade in that the display of the art image is an integral part of the lighting unit. Low manufacturing cost, compact storage in kit form, and ease of customer assembly are the hallmarks of the IDU. Although the manufactured frame parts are standardized in a range of sizes to minimize cost, the technique for creating the art sheets which are illuminated permits a wide range of image heights to be accommodated by the frame parts which are standardized. The IDU can be used as a table-top unit like an ordinary table lamp, or the very same unit can also be suspended by an integral electric pulley cord. As a table-top unit, the same frame elements can be used to illuminate and display a variety of art reproductions just by changing one art sheet for another. Since the electrical parts are provided as a completely pre-wired electrical set in the kit and a unique slot is provided to insert the electric assembly into the frame, no electrical experience nor tools are used in the customer assembly of the IDU kit.

Basically, the lamp socket is secured to the support frame part with a hand-tightened nut; then the art sheet is formed into an ellipse, or other shape, then simply attached to or secured around the support frame member and a second plain frame member is attached at the top. For table-top use, the support frame is at the bottom, and the plain frame is at the top of the art sheet. For suspended use, this is reversed. If for table top use with a pedestal, a tube and a second support frame to serve as a base (or a modified base) is added.

The production technique of printing the art sheet by high resolution wide-format ink jet printers is well known, although the material of the art sheet in this use is custom manufactured for the IDU application by virtue of its heat resistance, archival type ink acceptance, translucent neutral appearance, no visible grain pattern, and rigidity once curved into a shape around the frame members. One type of basic material that has these characteristics is styrene; fabric laminated to styrene may also be used depending on the effect desired. Wide format printers made by such companies as Epson, Canon, Hewlett Packard, Xerox and others offer widths from 24" to 72". For example, the 8-color 54" wide Epson Stylus GS6000 is one such printer that can be used to print art sheets. The IDU of this invention will be described as having an oval crossectional cylindrical shape as the display surface of the art sheet. The frame members are fixed sizes. For instance, a 24" wide art sheet formed around the appropriate size frame will fit on a frame with a major oval diameter of approximately 9.2" and a minor diameter of about 5.7". Provision is made for the art sheet and the frames to be permanently joined if required. The use of wider art sheets would permit IDU's of different larger or smaller standard sizes. Using this type of printing method the circumference of the IDU display is fixed by the width of the sheet being used, but the height of the art sheet can be easily varied since this is determined by the length of the sheet programmed to be printed. In this way, actual art sheet heights can practically be infinitely varied; but all would be accommodated by the same size IDU frame and related electrical kit.

The business model for this invention presupposes that a "company" is formed to produce art sheets and frame/electrical kits for IDU's that would interface with a variety of museum shops around the country or around the world. The company has a computer system which will communicate between the company and its customers. The computer system includes microprocessor and a database for receiving and storing data. The database has data processing systems by which the company and respective gift shops communicate via a browser controlling communications over a network via a server, images, plus any text required, formatted for printing by the company. All communications can be handled via internet for receiving orders, payment, and developing image files. In addition, tangible media forms such as DVD's, portable hard drives, scanned documents, memory sticks, or diskettes can be used instead. Another option is to transfer files via internet connected or direct cell phone communications. Products can be shipped by common carrier services. When a museum gift shop gears up for support of a special museum exhibit, materials related to the exhibit can be executed. The initial order for a new unit with a new image must first create an Image Art Unit (IAU) file with the exact edited digital representation of each image and any text required to be used on an art sheet. This is what will drive the wide format printer. The formatting from the source Exhibit Art Image file of the museum can either be done by the company (with instructions from the museum), or it can be performed by museum personnel using editing software supplied by the company. In all cases the instructions for customer assembly are printed on what will be an obscured part of the art sheet when assembly is completed.

The company uses pricing software which prices each art sheet corresponding to each desired IAU. Part of the pricing algorithm is based on the height and width of the particular resulting art sheet reflecting the actual substrate material and printing cost. Another pricing aspect may be the ink cost for a particular art sheet reflecting the actual digital color and color density information of each pixel of the art reproduction. Other aspects of pricing may include printer set-up charges and/or amortized formatting charges related to volume ordered. Once the pricing is set for the images, this is relayed to the museum gift shop. Based on demand estimates an initial order is placed for both the various art sheets as well as for IDU frame/electrical kits selected by the museum. The company will then schedule production and fulfill the initial order for art sheets and IDU's from the museum shop. Subsequent orders for IDU's and/or art sheets will be filled as required.

At the museum gift shop, customer order fulfillment can be accomplished in a number of ways. Customers may purchase desired art sheets and IDU kits, pay for them and leave. They may request an assembled IDU. This can be handled by on-demand assembly at the museum shop or from stock pre-assembled by the museum, or the museums shop can order the unit to be assembled by the company and shipped to the address given by the customer. Assembly for stock can be performed at the museum shop during slack periods.

BRIEF DESCRIPTION OF THE DRAWINGS

The present invention can best be understood in connection with the accompanying drawings. It is noted that the invention is not limited to the precise embodiments shown in drawings, in which:

FIG. 3 is a top plan view of the two part frame set showing the plain frame as well as the support frame.

FIG. 4 is a crossection detail of the art sheet support edge of each frame member showing the edge of the art sheet abutting a layer of attachment tape FIG. 5 is a plan view of the pre-wired electrical kit that is part of the IDU kit which also includes both frame sections. (in the case illustrated this is for a table top unit and incorporates a dimmer. Alternative electrical kits will be available, including a kit with a pulley cord for suspended units.)

DETAILED DESCRIPTION OF THE INVENTION

The present invention has broad applications to many fields for a variety of articles. For illustrative purposes only, a preferred mode for carrying out the invention is described herein.

Figure 1:
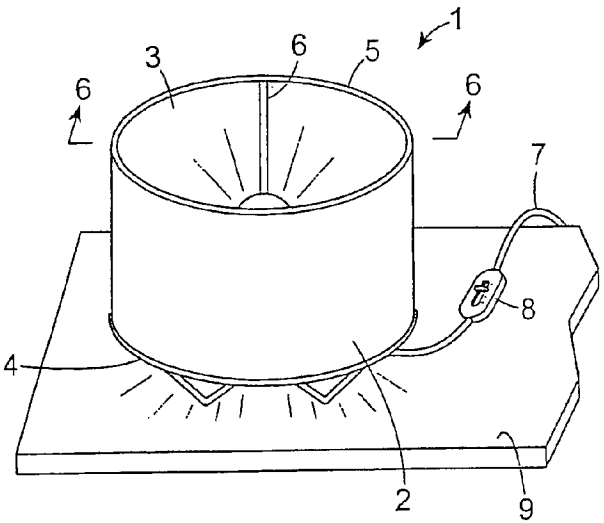
FIG. 1 is a perspective view of an assembled IDU in use on a table top.

FIG. 1 shows a table top 9 on which IDU 1 with art sheet 3 displaying art image 2 rests. Art sheet 3 is contained and shaped between support frame 4 at the bottom edge incorporating support legs facing down and plain frame 5 at top edge. A small overlap 6 of the free ends is at the rear of the display unit. Electrical control (switch or switch/dimmer) 8 is shown on electrical line 7.

Figure 1B:
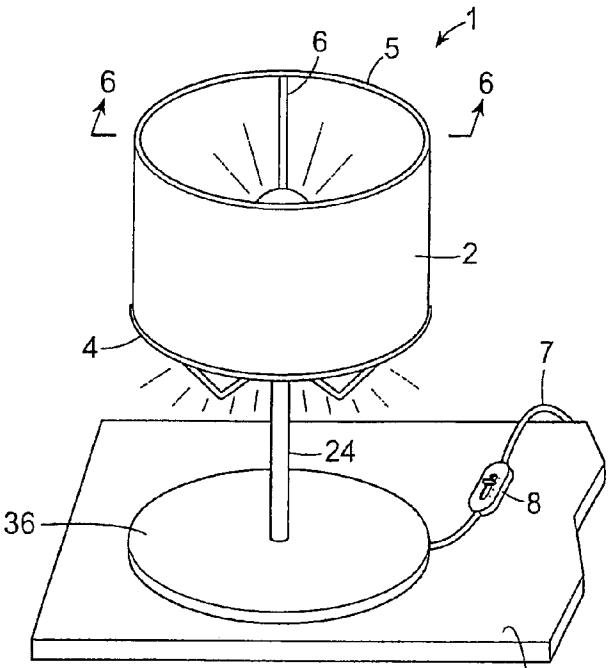
FIG. 1B is a perspective view of an assembled IDU with a base using a modified base in use on a table top.
Figure 1A:
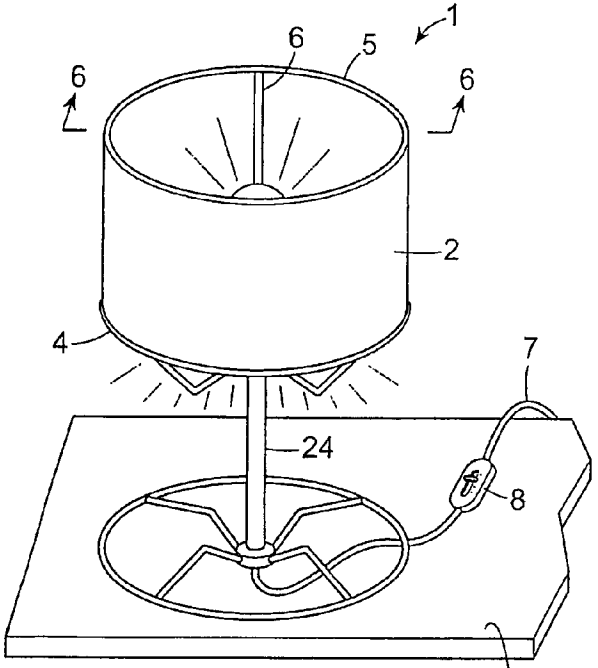
FIG. 1A is a perspective view of an assembled IDU with a pedestal using a second support frame at the base in use on a table top.

FIG. 1A is a similar image of the same IDU 1 but with a pedestal tube and second support frame added at the base.

FIG. 1B is a similar image of the same IDU 1 but with a pedestal tube and with a modified base.

Figure 2:
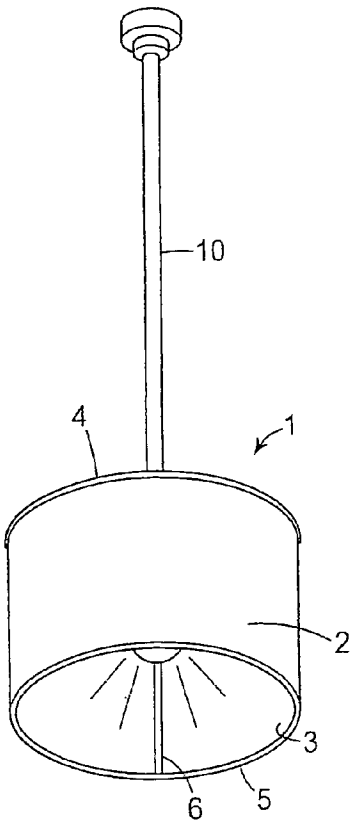
FIG. 2 is a perspective view of an assembled IDU suspended by pulley cord.

FIG. 2 is a similar image of the same IDU 1 configured for hanging from pulley cord with support legs facing up 10.

FIG. 3 shows the two part frame. The plain frame 5 is an oval member. The support frame 4 is also oval but incorporates four legs 14 leading at the center to lamp socket support disk 12 with a central hole for the socket nipple 17 and a side slot for electric wire insertion 18.

Each of the art sheet support edges of the frames have an L-shaped crossection (see FIG. 4) which supports a top or bottom edge of art sheet 3. These supports also have a layer of tape attached with a release liner 15. The release liner can be removed prior to assembly to expose an adhesive layer for permanent attachment of the art sheet to the frame. This is optional for the table top unit where gravity holds the art sheet to the support frame 4 and to the plain frame 5. For the hanging configuration where gravity tends to pull the three sections apart, the adhesive layer 15 must be exposed and used.

FIG. 5 shows a pre-wired electrical set 20 consisting of lamp socket 21 with pre-attached short threaded nipple 22, nut 23, control 8, extension cord 7, and wall plug 25. Line cord 7 fits through slot 18 on socket support disk 12 which then permits short threaded nipple 22 to fit through the center hole 17 for attachment even though the entire electrical set is pre-wired.

Figure 5A:
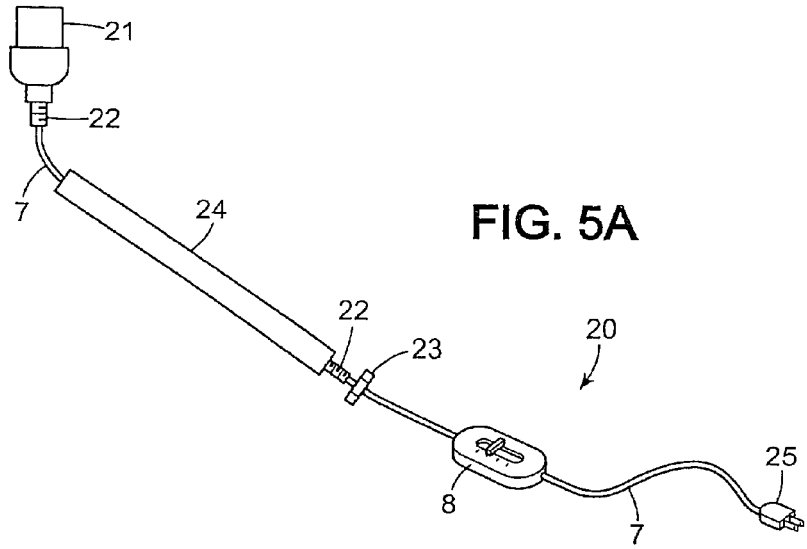
FIG. 5A is a plan view of an alternative electrical kit for a table top unit with a pedestal that will use a second support frame as a base.

FIG. 5A shows a pre-wired electrical set 20 consisting of lamp socket 21 with pre-attached short threaded nipple 22, tube with internal threads to fit nipples at both ends 24, with pre-attached short threaded nipple at the end opposite the lamp socket 22, nut 23, control 8, extension cord 7, and wall plug 25. Line cord 7 fits through slot 18 on socket support disk 12 which then permits short threaded nipple 22 to fit through the center hole 17 for attachment even though the entire electrical set is pre-wired.

Figure 5B:
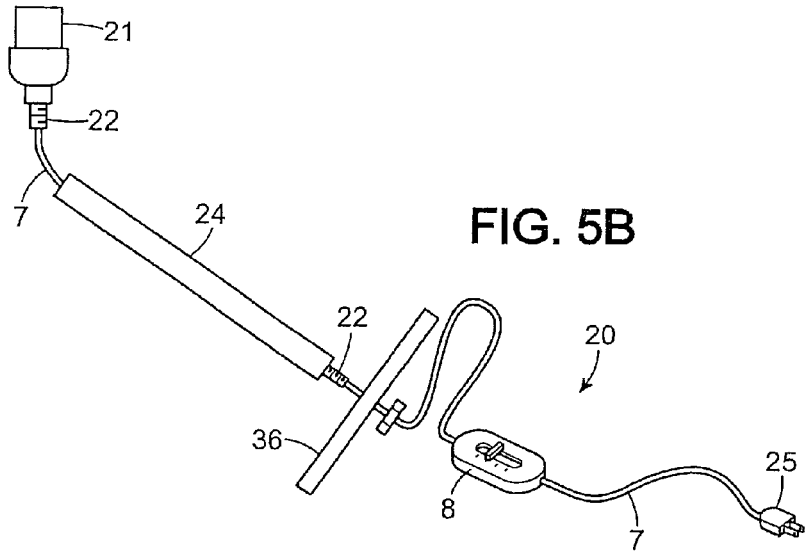
FIG. 5B is a plan view of an alternative electrical kit for a table top unit with a pedestal using a modified base.

FIG. 5B shows the same electrical set as 5A but with a modified base unit 36 on line cord 7.

Figure 6:
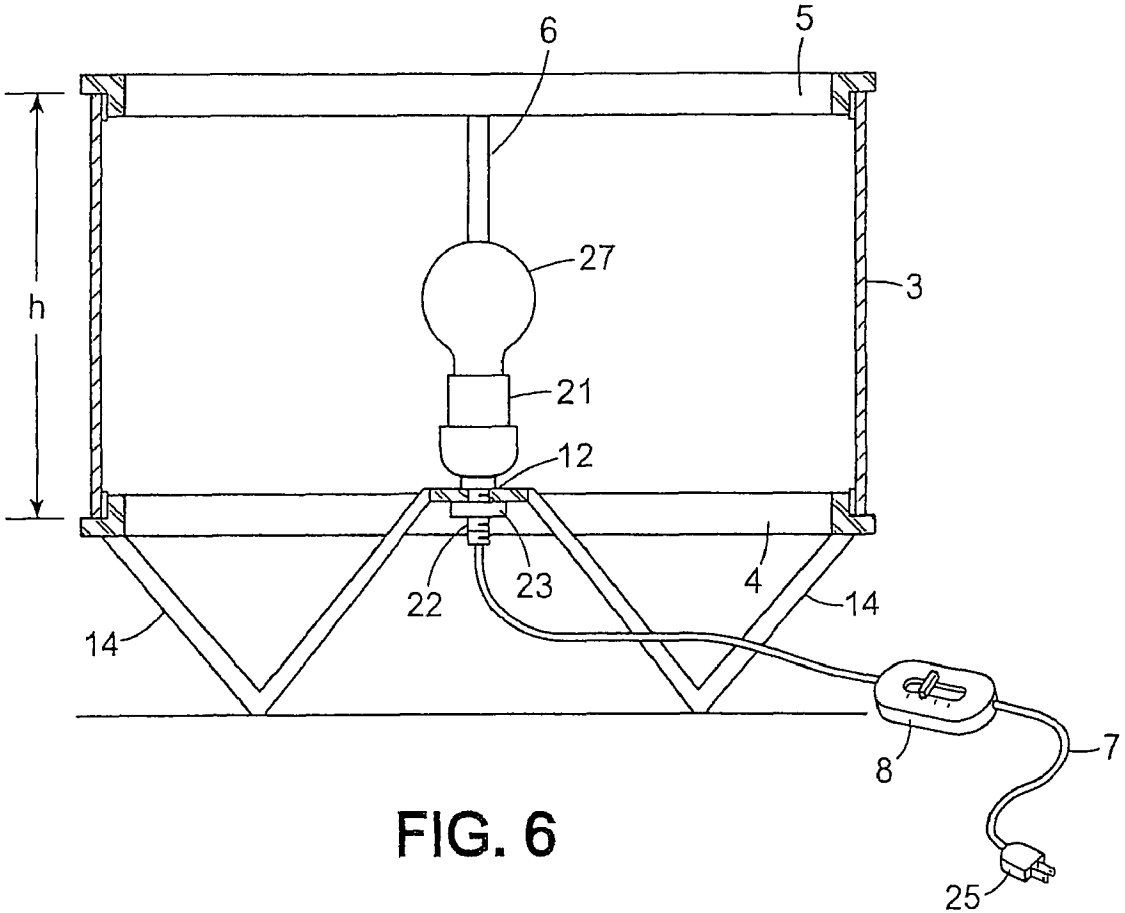
FIG. 6 is a side view crossection of an assembled tabled table top IDU taken along the major diameter of the oval shape.

FIG. 6 shows how the various parts fit together; bulb 7 (or optional CFL) is not part of the electrical kit because of fragility concerns. Note that legs 14 on support frame 4 bend down to create integral legs. The preferred fabrication of both frame parts is injection molding using a glass filled polycarbonate resin. This means that support frame 4 would be formed as a single piece. Alternate multi-part fabrication of frame members 4 and 5 is possible through die forming and spot welding of steel or aluminum sections.

Figure 6B:
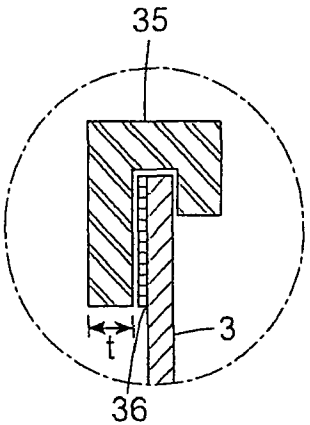
FIG. 6B is a side crossection detail of a modified edge as shown in FIG. 6A.
Figure 6A:
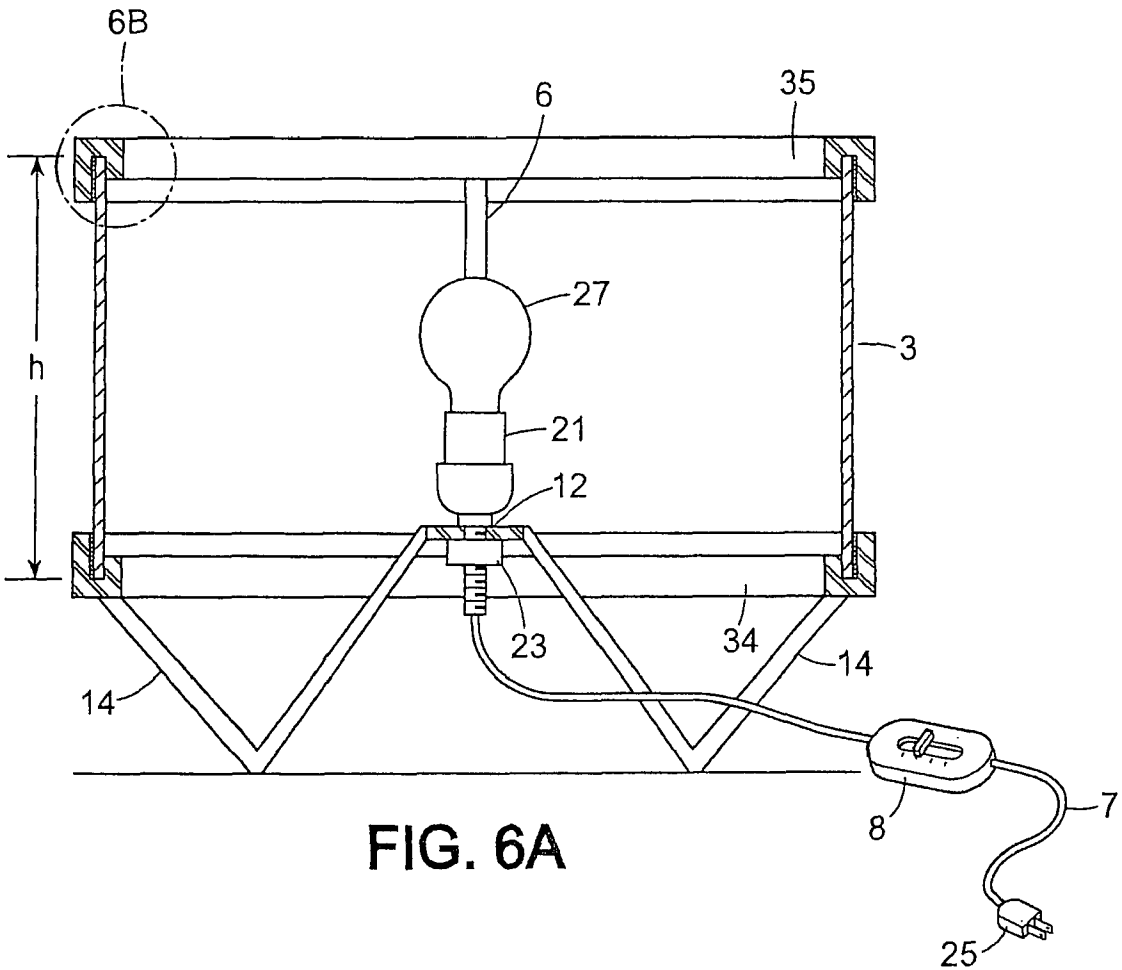
FIG. 6A is a side view crossection of an assembled table top IDU of an alternate embodiment using modified frame support edges.

FIG. 6A shows an alternate embodiment of IDU using another design of support edge with an outer support lip on plain frame 35 and support frame 34. The detail of FIG. 6B shows how such an edge engages art sheet 3 at top edge. Note that double-sided tape with release liner 36 may be attached to art sheet 3 or to the frame edge is in either design. Frame edge material thickness T is nominally EDM 3/32" with other dimensions relatively scaled.

Figure 6C:
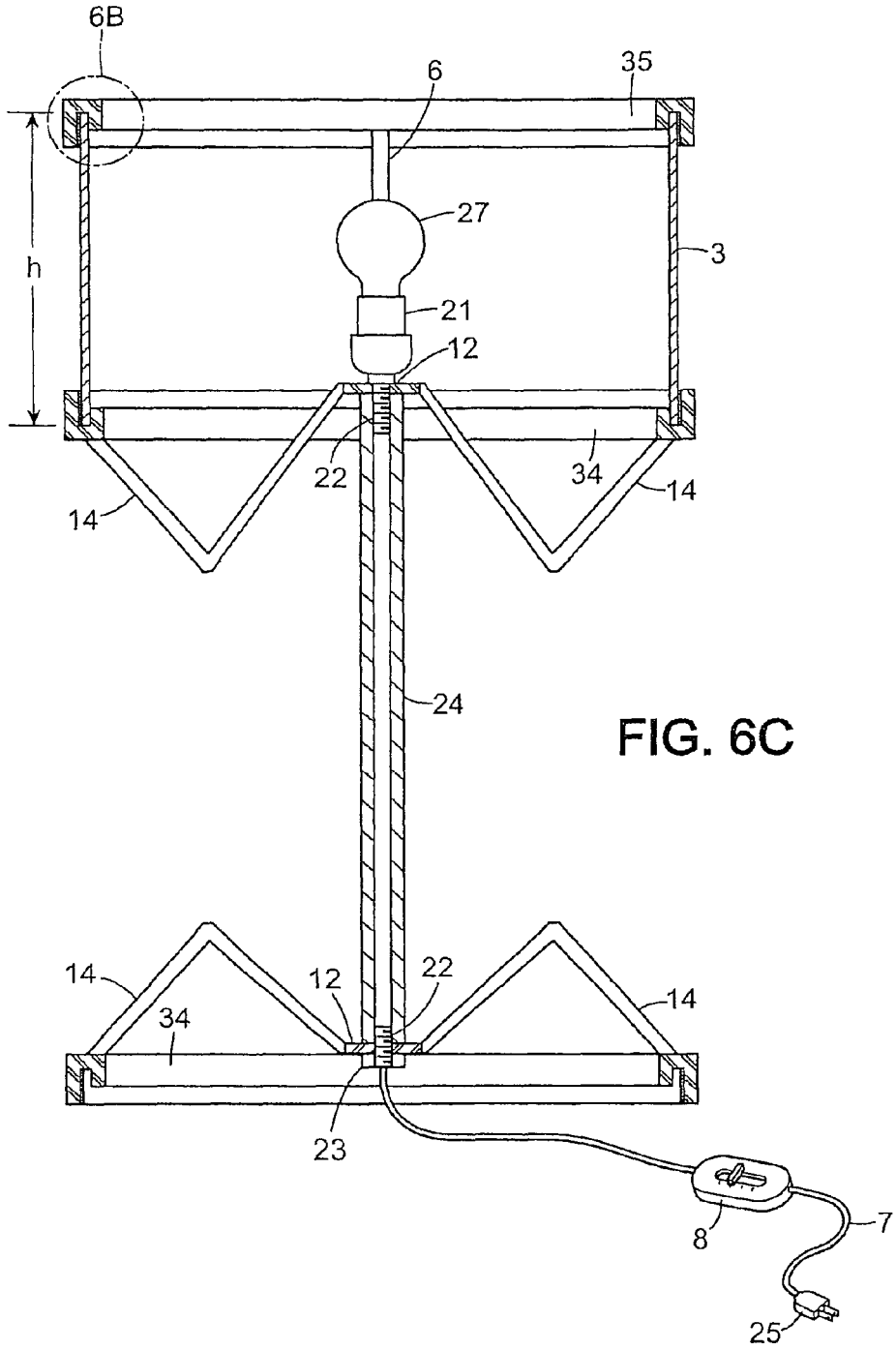
FIG. 6C is a side view cross section of an assembled table top IDU with a pedestal using a second support frame member as a base.

FIG. 6C shows another alternate embodiment of IUD to provide a pedestal between the art display unit and a table top. This shows how the pedestal tube internally threaded at both ends 24 screws on to the short threaded nipple 22 on the lamp socket 21 and at the other end on to a second short nipple 22 which is inserted into center disk 12 on a second support frame 34, positioned upside down, and held in place by nut 23.

Figure 6D:
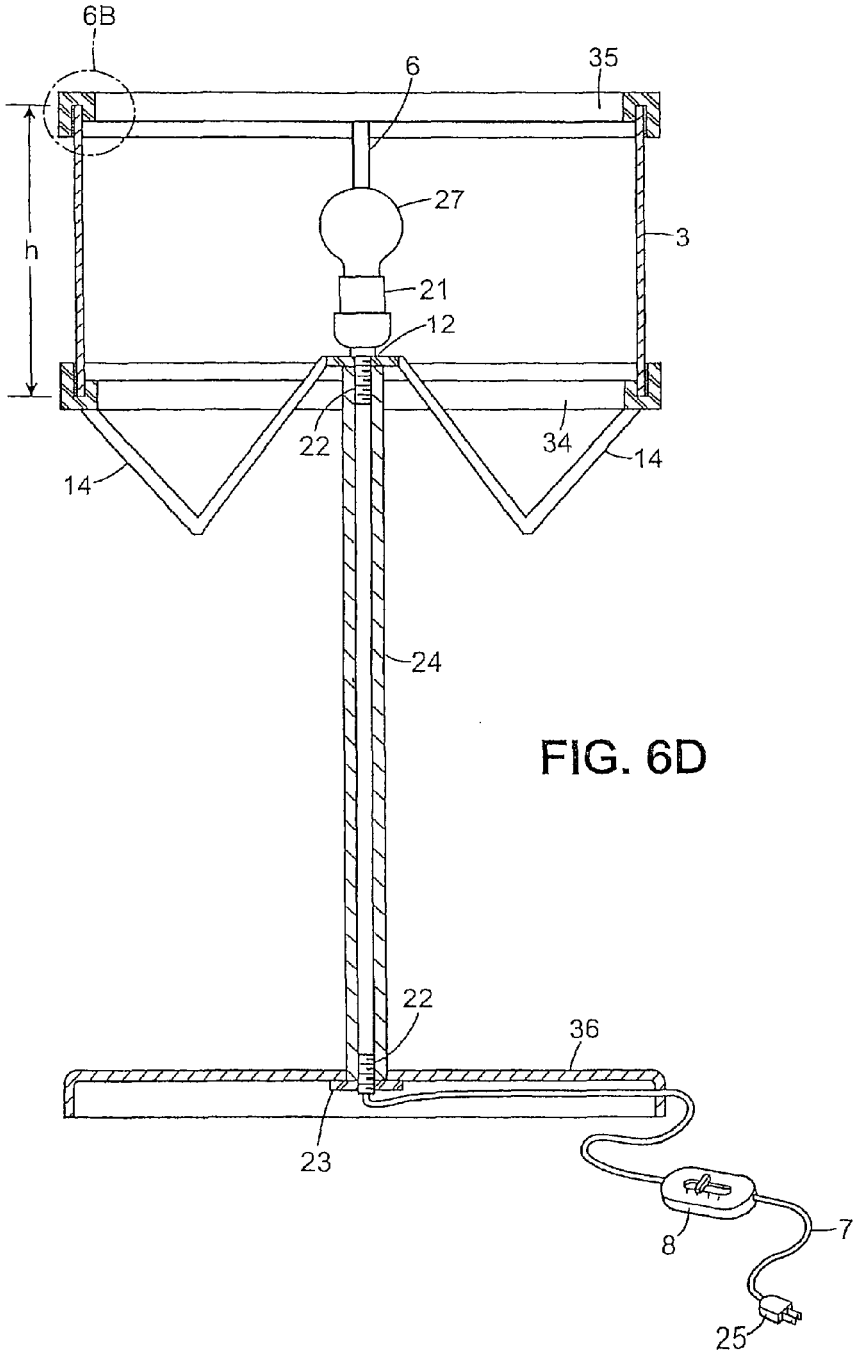
FIG. 6D is a side view cross section of an assembled table top IDU with a pedestal using a modified base.

FIG. 6D shows the modified base 36 illustrated in FIG. 1A, which assembles in same manner as the parts in FIG. 6C but must be provided pre-threaded on the electric wire as part of the electric kit because it does not have the unique slot provided for wire insertion that is on the support frame 34.

Figure 7:
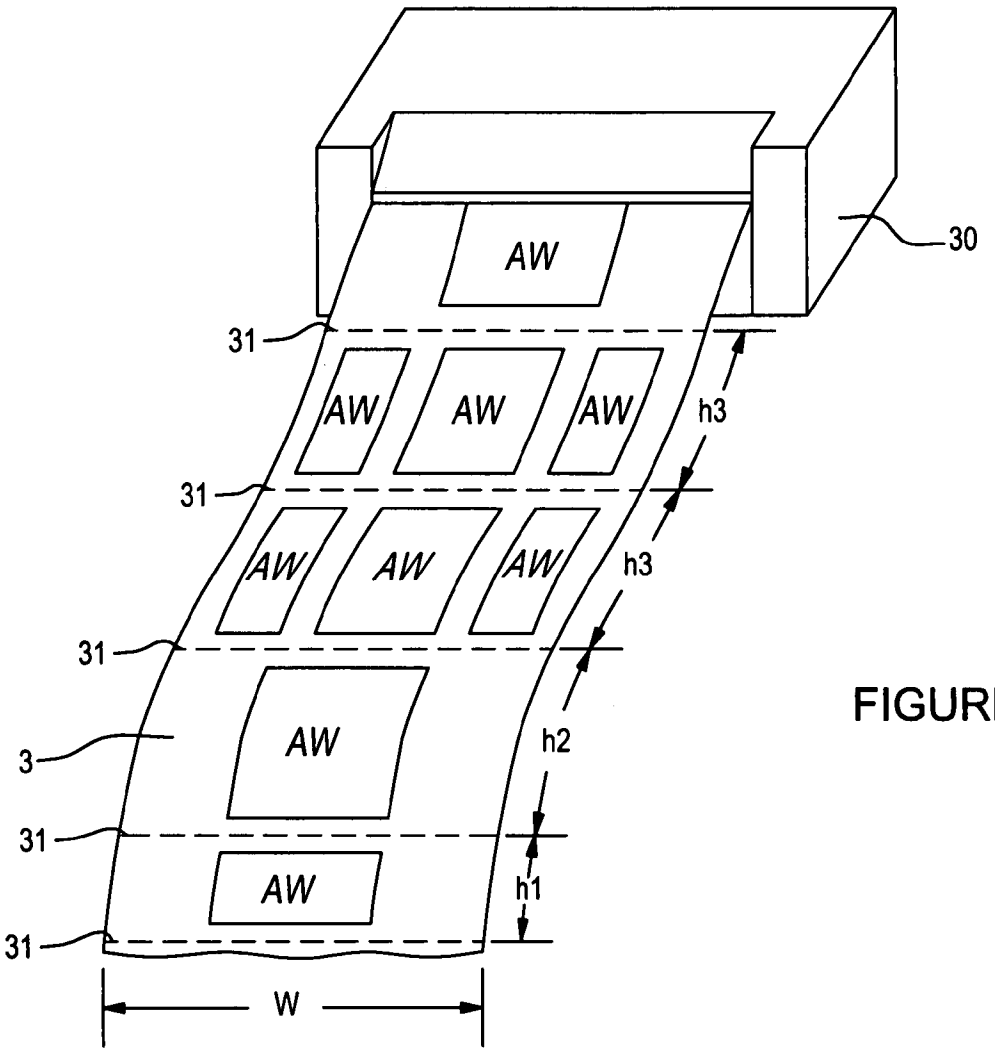
FIG. 7 is a perspective schematic view showing a continuous portion of art sheet material merging from a printer with a variety of art works printed on art sheet sections (prior to cutting apart for each IDU).

FIG. 7 shows wide format printer 30 spewing out a long sheet of art sheet material which will be sliced at dashed lines 31 to form individual strips (all of the same circumferences length "W") which will become art sheets 3 displaying art work "AW" after cutting into separate units. Note the heights of the different art sheets (h1, h2, h3) varies with the particular AW being printed since they are determined by the programmed feed distance of the printer and are therefore infinitely variable.

Figure 8:
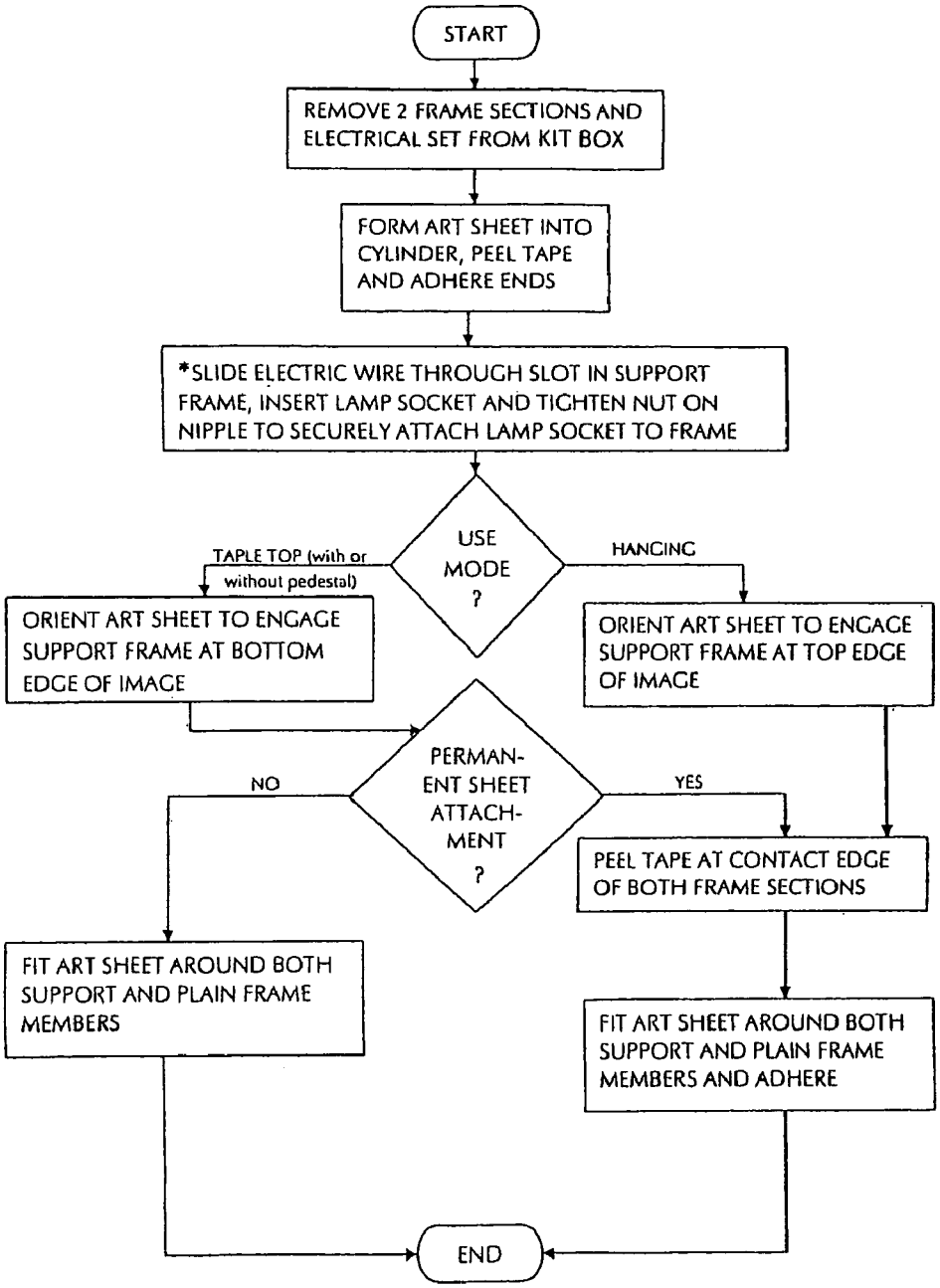
FIG. 8 is a flow chart describing the assembly of an IDU.

The IDU assembly flow chart of FIG. 8 is largely self-explanatory. Note that the orientation of the art to the support frame is different depending on whether a table top or hanging version of IDU 1 is being assembled; this can be easily seen in FIGS. 1 and 2. Although permanent or temporary assembly is an option for a table top unit, the hanging version must be bonded together with the tape around the edge of the frame sections. Temporary assembly of the table top unit permits using the same frame kit serially for a variety of art sheet displays.

Figure 9:
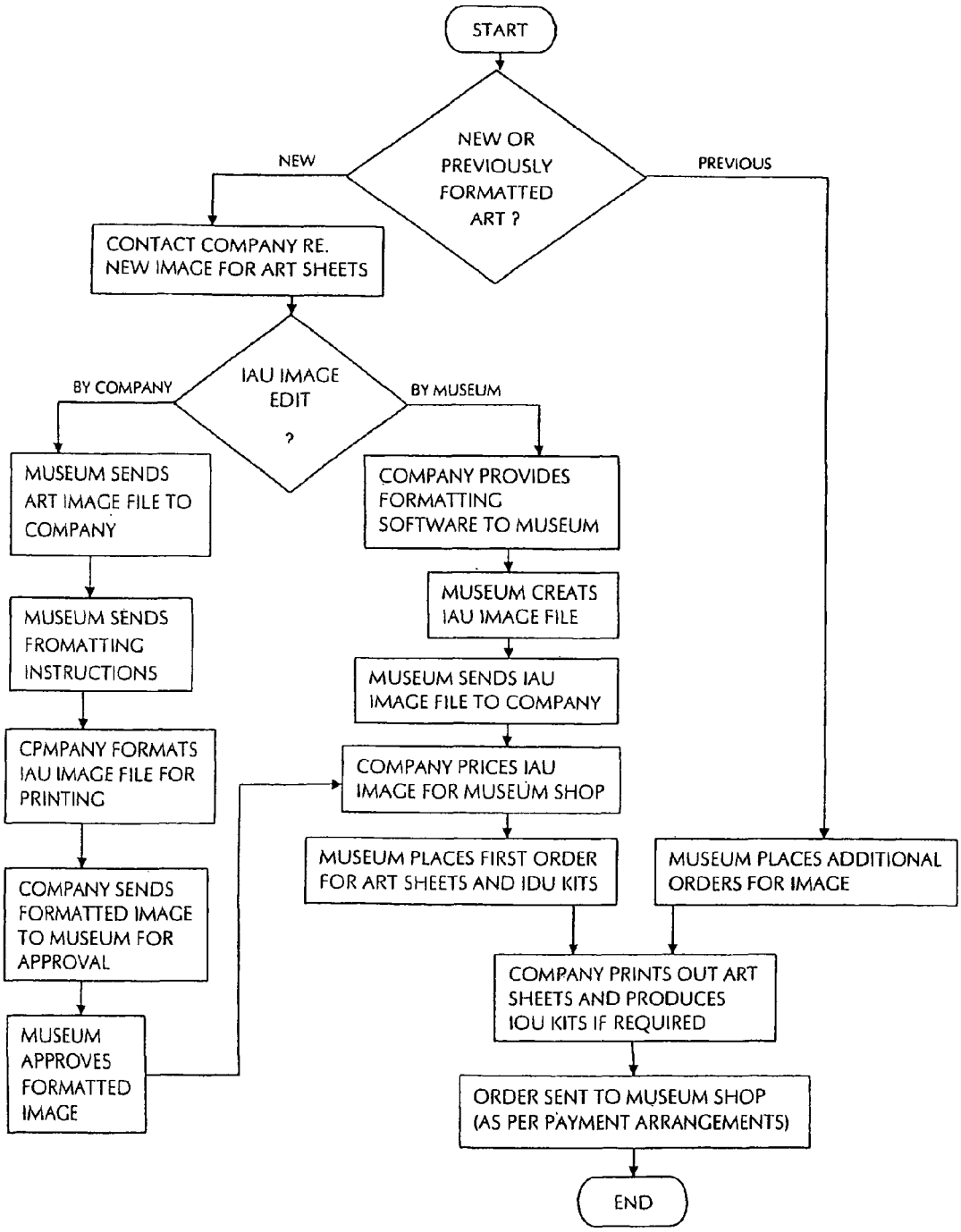
FIG. 9 is a flow chart of the initial order set-up supporting a new museum exhibit.

The process for the initial and subsequent order set-up with a museum gift shop was described in words in the summary section. FIG. 9 shows this process in flow chart form. This shows the optional methods of performing the formatting of the museum Exhibit Image File to create and Image Art Unit file of final digitized images to actually drive the printer to print out art sheets. The accurate pricing of each art sheet can only be performed after this step.

Figure 9A:
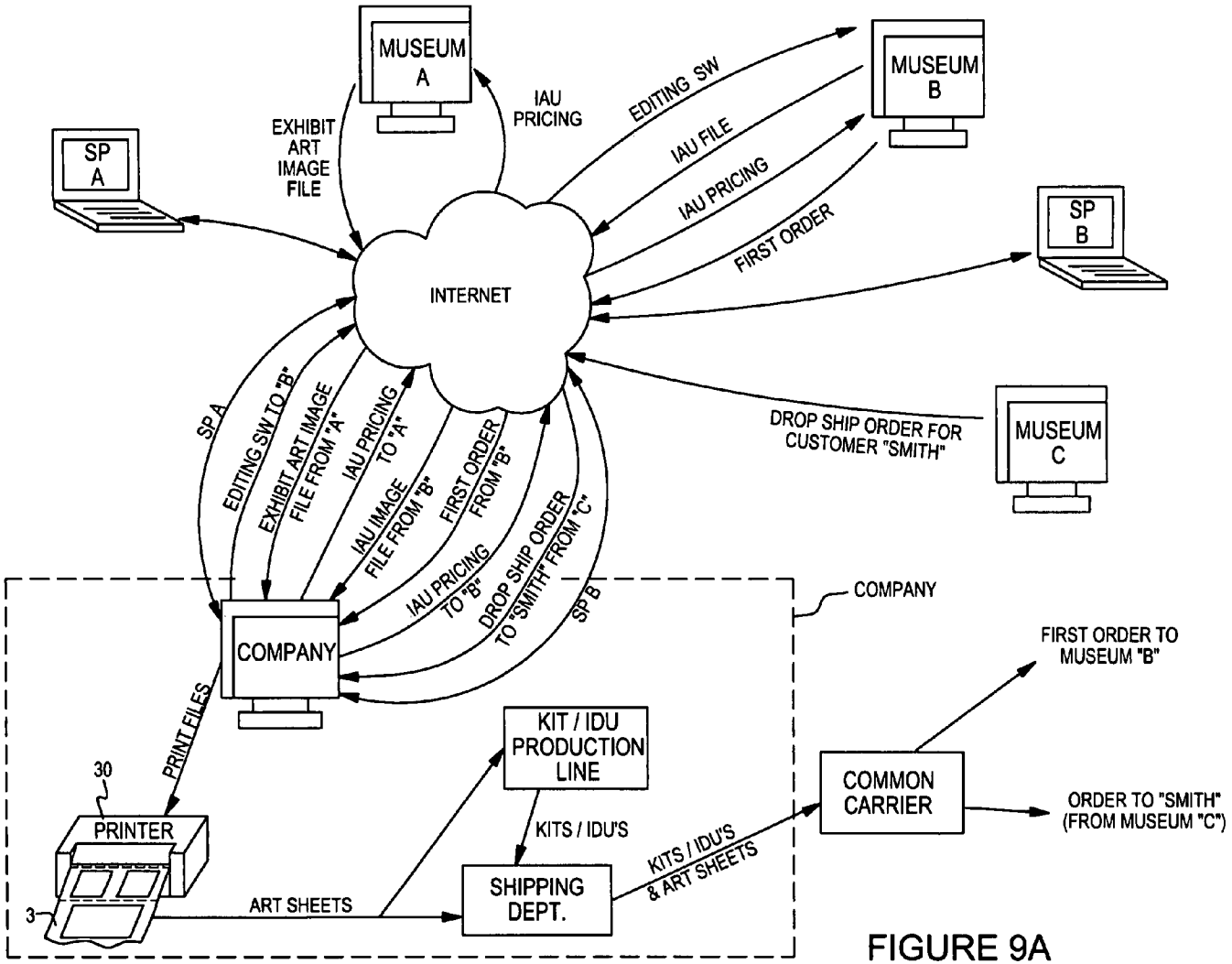
FIG. 9A is a block diagram reflecting the hardware and network entities involved in implementing the flow chart of FIG. 9.

The flow chart of FIG. 9A clearly illustrates the computer hardware and network entities involved in actually implementing the order process. The box labeled "Company" in FIG. 9A includes a computer system including a central processing unit (CPU) or microprocessor facilitating communications enabled by a server through the internet between the company and three different museum gift shops is shown. Museums A and B are involved in initial order set-up, but museum A lets the company edit their exhibit art image file while Museum B edits their own exhibit art image file to an IAU file using software provided by the company. In both cases, IAU pricing is provided by the company. Museum C sends a drop shop order to the company for a customer named "Smith". Both IDU kits as well as fully assembled IDU's with attached art sheets can be shipped out. The company keeps up with the museum interaction with its computer and microprocessor throughout the internet. Field representatives or company sales persons (as represented by "laptops" SP-A and SP-B) can also be used to send in orders resulting from museum gift shop visits or other communications. FIG. 9A also indicates how the company with its computer CPU or microprocessor creates the art sheets on printer 30 and produces kits from an internal production line (as shown). Electric/frame kits and art sheets, or fully assembled IDU's, are shipped by a common carrier to the museum shops or to specific "drop ship" museum customers.

Figure 10:
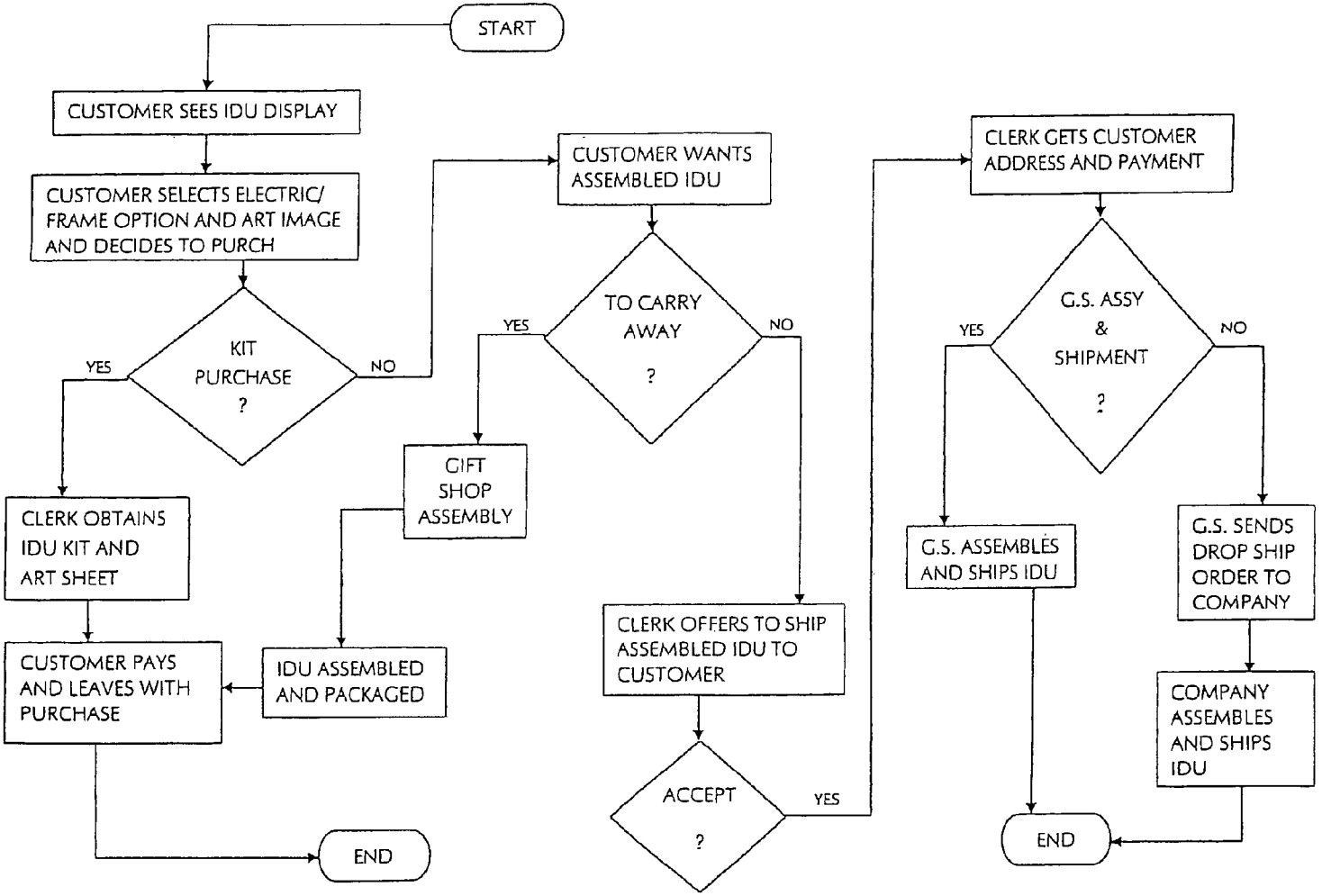
FIG. 10 is a flow chart depicting the various customer fulfillment options at a museum gift shop.

The different customer order fulfillment options discussed above in the summary are detailed in the flow chart of FIG. 10.

Although the main objective of this invention is to create an efficient method of displaying art that may be purchased at a museum shop, many other uses for an IDU unrelated to museums or fine art exist. One is a direct internet to customer marketing method whereby the "artwork" (which may, for instance, consist of family snapshots) is provided by the customer for creating an art sheet. Another possibility is advertising use of IDU's such as displays promoting a certain brand of beer at a tavern. The oval format described may not be optimal for theses unrelated applications. It is possible to use the identical manufacturing steps to create IDU's of any cylindrical crossection by using frames that have the alternate peripheral shape.

While intended use is to illuminate the translucent art sheet, under ambient light the art sheet still displays the art work image thereon.

Figure 11:
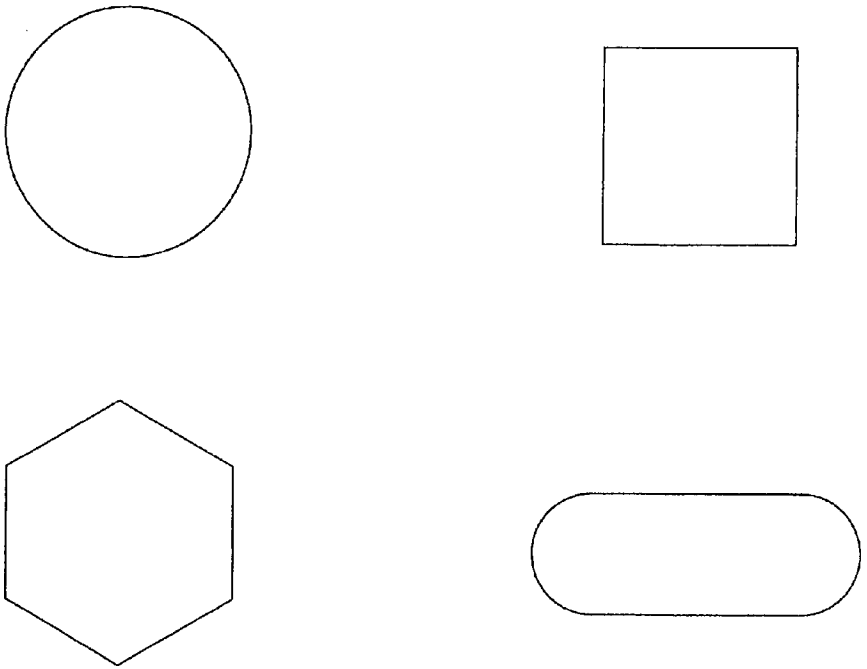
FIG. 11 is a schematic top view of four different designs of IDU shapes each with the same circumference

FIG. 11 schematically shows four examples of alternative top outline views of an IDU. They are drawn at the same scale to show the relative feature size for a constant circumference. The circle and oblong shapes would be easily produced, while the sharp corners of the square and hexagonal shapes would be somewhat rounded in practice to prevent creasing of the art sheet. The shape can be applicable to any shaped polygon, such as hexagonal or pentagonal, etc.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only a, and are not meant to limit the scope of the present invention.

It is further known that other modifications may be made to the present invention, without departing the scope of the invention, as noted in the appended Claims.

I claim:

1. An illuminated display unit in kit form for displaying and lighting a museum or other institutional gift shop art sheet in a residential home setting comprising:

a pre-wired electrical set comprising of a lamp socket with a threaded nipple, a hand tightened nut engageable with said nipple, and an attached line cord;

an art sheet of translucent material, said art sheet having a work of art or other image reproduced on a surface of said art sheet;

said art sheet having top and bottom edges and left and right side edges, said art sheet being rolled so that said left and right edges are joined by a vertically extending adhesive tape member provided with said art sheet;

a plain frame in the form of a loop with a peripheral shoulder to engage an edge of said art sheet and guide said art sheet into a conforming closed shape around said plain frame;

a support frame having a loop member with a peripheral shoulder matching that of said plain frame to engage an edge of said art sheet distal to that engaged with said plain frame, said support frame also comprising three or more radially extending members attaching said loop member to a centrally located bulb socket support disk;

said socket support disk having a hole dimensioned to accept said socket nipple with a peripheral slot of smaller width than said hole diameter to allow access to said line cord permitting locking of said lamp socket into said socket support disk by hand threading said nut onto end of said nipple after insertion into support disk;

said radially extending members bent into V-shapes forming legs for table-top use while locating said lamp socket at a proper height for illuminination of said art sheet; and each support shoulder of said loops of said frames engageable with respective upper and lower edges of said rolled art sheet whereby when said kit is assembled said display unit may be assembled by a user without use of tools and said art sheet may be replaced by a subsequent art sheet.

2. The illuminated display unit of claim 1 further comprising a modified base including a second support frame/lamp support base to support an illuminated display unit mounted on a pedestal tube for table-top use.

3. The illuminated display unit of claims 1 or 2 wherein said loops of said plain frame and said support frame and said modified base are oval shaped.

4. The illuminated display unit of claims 1 or 2 in which said loops of said plain frame and said support frame loops and said modified base are round shaped.

5. The illuminated display unit of claims 1 or 2 in which said loops of said plain frame and said support frame and said modified base are rectangular shaped.

6. The illuminated display unit of claims 1 or 2 in which said loops of said plain frame and said support frame and said modified base are oblong shaped.

7. The illuminated display unit of claims 1 or 2 in which said loops of said plain frame and said support frame and said modified base are polygonal shaped.

8. The illuminated display unit of claim 2 wherein said pre-wired electrical set comprises an extended tube internally threaded at both ends for receiving nipples at both ends thereof for attaching said second support base to said bulb socket center disk.

9. The illuminated display unit of claim 1 wherein said art sheet is comprised of styrene material.

10. The illuminated display unit of claim 9 wherein said styrene material has a fabric laminated thereon.

11. The assembled illuminated display unit of claim 1 wherein use as a table-top unit is completed by screwing a lamp into said lamp socket and supporting said unit on said legs on a horizontal surface and plugging into an electrical outlet.

12. The assembled illuminated display unit of claim 1 wherein use as a table-top unit is completed by screwing a lamp into said lamp socket and supporting said unit on a pedestal formed by a tube connecting said assembled illuminated display unit to a base resting on a horizontal surface and plugging into an electrical outlet.

13. The assembled illuminated display unit of claim 1 wherein use as a hanging unit also requires the steps of attachment of both top and bottom edges of said art sheet to both respective said frame loops, attaching the distal end of pulley cord, or similar tension support element, to a ceiling support and providing an electrical connection and screwing a lamp into said lamp socket.

14. The illuminated display unit as in claim 1 wherein said a fastener assembly engages said peripheral shoulder of said loops of said frames.

15. The illuminated display unit as in claim 1 wherein said fastener assembly is a attached layer of adhesive tape with a release liner whereby when said release liner is removed the adhesive is exposed for attachment of the art sheet to said loops of said frames.

* * * * *